US007374457B1

(12) United States Patent
Oksengendler et al.

(10) Patent No.: US 7,374,457 B1
(45) Date of Patent: May 20, 2008

(54) INLINE QUICK DISCONNECT SYSTEM WITH STRAIN RELIEF

(75) Inventors: Alex Oksengendler, Buffalo Grove, IL (US); Joseph F. McCormick, Melrose, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/810,542

(22) Filed: Jun. 6, 2007

(51) Int. Cl.
*H01R 33/00* (2006.01)

(52) U.S. Cl. ..... 439/660; 439/357; 439/457; 362/219

(58) Field of Classification Search ..... 439/226, 439/237, 238, 345, 356, 357, 449, 456–458, 439/660; 362/95, 219
See application file for complete search history.

(56) References Cited

U.S. PATENT DOCUMENTS 6,659,622 B2 * 12/2003 Katogi et al. ..... 362/219
6,969,179 B2 * 11/2005 Sloan et al. ..... 362/219
6,984,055 B2 * 1/2006 McCarthy et al. ..... 362/219
7,055,982 B2 * 6/2006 Yaphe et al. ..... 362/147
7,144,129 B2 * 12/2006 Mackin ..... 362/223
7,293,895 B2 * 11/2007 Grossman et al. ..... 362/219

* cited by examiner

*Primary Examiner*—Khiem Nguyen
(74) *Attorney, Agent, or Firm*—Carlo S. Bessone

(57) ABSTRACT

A lighting system (10) has: a fixture (12) with an axis of orientation (14); and a light source (16) mounted within the fixture (12). A ballast (20), usually positioned on the side of the fixture away from the light source, is associated with the light source (16), the ballast (20) having a first end (22) attached to the light source (16) via appropriate wires and a second end (24) attached to an electrical power source (26), also by appropriate wires. The connector (28) is composed of inline electrical connector halves (30, 32) having proximal mating ends (34, 36), an axis of attachment (38) and distal ends (40, 42) provided with strain relief mounting means (44). One of the electrical connector halves, for example, (30), has a locking tongue (46) extending along the axis of attachment (38) and the other half, (32) in this instance, has a locking tongue receptor (48) for receiving the locking tongue (46), the tongue and receptor functioning to maintain the connector halves in a joined and locked position.

4 Claims, 2 Drawing Sheets

INLINE QUICK DISCONNECT SYSTEM WITH STRAIN RELIEF

TECHNICAL FIELD

This invention relates to lighting systems and more particularly to such systems where the light source employs a ballast. Such systems include, for example, fluorescent lighting.

BACKGROUND ART

The fluorescent lighting used in many office buildings and similar structures usually comprises long (for example, four to eight feet in length, fixtures that mount one or more fluorescent tubes. Because the lamps operate from a gaseous discharge, a ballast is required. The ballast provides circuitry that controls the electrical current through the lamp during its startup and subsequent operation. For many years it has been the practice to "hardwire" the ballast into the system. Thus, while it is possible to replace a lamp or lamps without shutting off the main power supply, because the ballasts were hardwired into the system replacement necessitated deactivating the complete power supply, usually at the mains, which causes a good deal of unnecessary disruption.

DISCLOSURE OF INVENTION

It is, therefore, an object of the invention, to obviate the disadvantages of the prior art.

It is another object of the invention to enhance ballast replacement.

These objects are accomplished, in one aspect of the invention, in a lighting system that includes a fixture with an axis of orientation; a light source mounted within the fixture, at least a portion of the light source extending along the axis of orientation; a ballast associated with the light source, the ballast having a first end attached to the light source and a second end attached to an electrical power source: the improvement comprising: the second end attachment comprising a connector composed of inline, electrical connector halves having proximal mating ends, an axis of attachment and distal ends provided with strain relief mounting. This system allows an individual ballast to be removed safely, without disrupting the remainder of the system.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
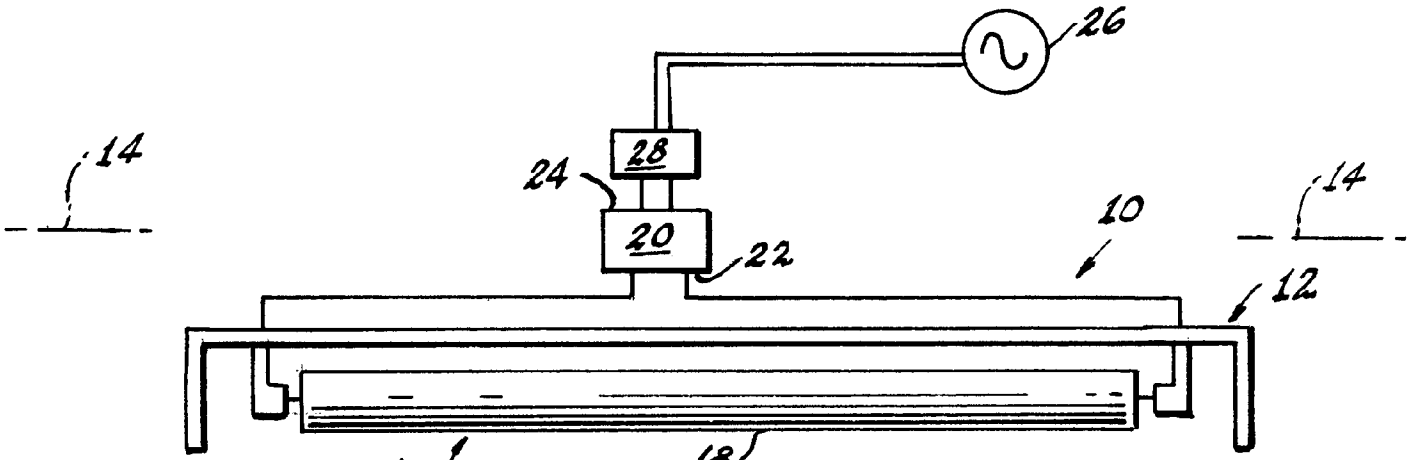
FIG. 1 is a diagrammatic view of a lighting system in accordance with an aspect of the invention.
Figure 2:
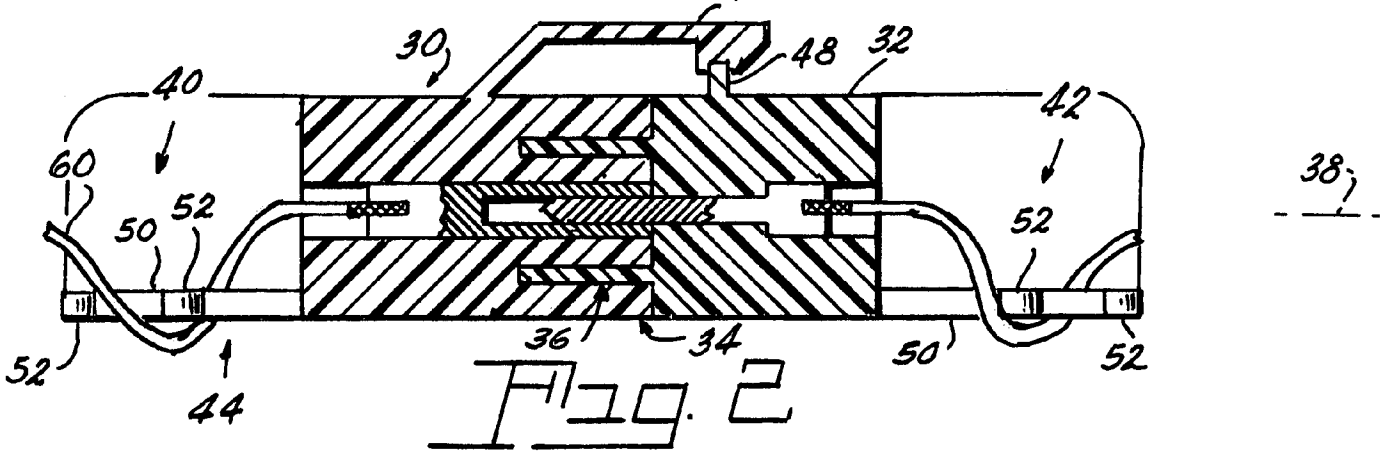
FIG. 2 is an elevational sectional view of an embodiment of the invention.

Referring now to the drawings with greater particularity, there is shown in FIG. 1 a lighting system 10 having: a fixture 12 with an axis of orientation 14; and a light source 16 mounted within the fixture 12. The fixture can be steel or aluminum, preferably with a reflective surface for spreading the light from the light source evenly.

The light source in this instance is shown as being a linear fluorescent tube. While U-shaped lamps are known, at least a portion 18 of the light source 16 extends along the axis of orientation. A ballast 20, usually positioned on the side of the fixture away from the light source, is associated with the light source 16, the ballast 20 having a first end 22 attached to the light source 16 via appropriate wires and a second end 24 attached to an electrical power source 26, also by appropriate wires.

At least some of the objects of the invention are achieved by interposing a connector 28 between the second end 24 of the ballast 20 and the power source 26.

The connector 28 is composed of inline electrical connector halves 30, 32 having proximal mating ends 34, 36, an axis of attachment 38 and distal ends 40, 42 provided with strain relief mounting means 44.

One of the electrical connector halves, for example, 30, has a locking tongue 46 extending along the axis of attachment 38 and the other half, 32 in this instance, has a locking tongue receptor 48 for receiving the locking tongue 46, the tongue and receptor functioning to maintain the connector halves in a joined and locked position. Of course, the positions of the locking tongue and receptor can be reversed, if desired.

The strain relief mounting means 44 formed on the distal ends comprises a projection 50 extending along the axis of attachment 38 and a plurality of spaced apart, transverse nubs 52 positioned on the projection 50.

Each of the electrical connector halves 30, 32 contains first and second electrical contacts 30*a*, 30*b* and 32*a*, 32*b* respectively, having mating ends 30*c*, 30*d* and 32*c*, 32*d* respectively and wire fixing ends 54*a*, 54*b*, and 56*a*, 56*b*. The contacts comprise the usual male-female portions and it is not material to this invention which connector half contains which contact. First and second pairs of wires 60, 62 and 64, 66 are connected, respectively, to the wire fixing ends 54*a*, 54*b* and 56*a*, 56*b*, the first and second pairs of wires 60, 62 and 64, 66 being wound about the transverse nubs 52 to provide strain relief.

Figure 3:
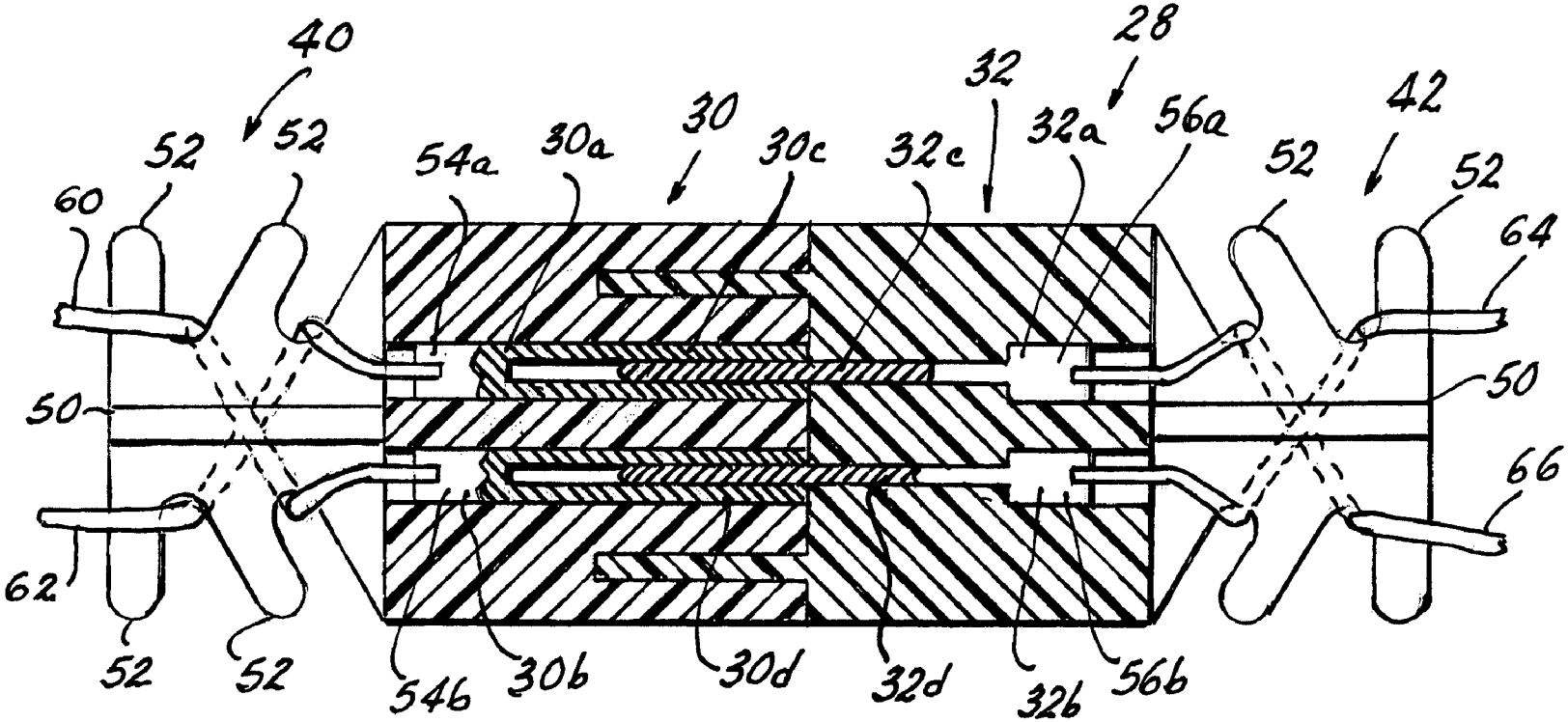
FIG. 3 is plan, sectional view of an embodiment of the invention.

In a preferred embodiment of the invention, the wires criss-cross in an X pattern as shown in FIG. 3 and, thus, first wire 60 connects to wire fixing end 54*b* of contact 30*b* and second wire 62 connects to wire fixing end 54*a* of contact 30 and so forth and so on.

Other configurations are of course possible, so long as the strain relief provided is sufficient to prevent the pulling force applied to the wires from propagating to the wire terminals inserted in the connector body and, as a result, degrading or breaking the electrical and/or mechanical connections between the wires and the terminals and thus exposing the operator to line voltage.

While there have been shown and described what are at present considered to be the preferred embodiment of the invention, it will be apparent to those skilled in the art that various changes and modifications can be made herein without departing from the scope of the invention as defined by the appended claims.

What is claimed is:

1. A lighting system having: a fixture with an axis of orientation; a light source mounted within said fixture, at least a portion of said light source extending along said axis of orientation; a ballast associated with said light source, said ballast having a first end attached to said light source and a second end attached to an electrical power source;

the improvement comprising:

said second end attachment comprising a connector composed of inline, electrical connector halves having proximal mating ends, an axis of attachment and distal ends provided with strain relief mounting.

2. The lighting system of claim 1 wherein a first of said electrical connector halves has a locking tongue extending along said axis of attachment and a second of said connector halves has a locking tongue receptor for receiving said locking tongue.

3. The lighting system of claim 1 wherein said strain relief means comprises a projection extending along said axis of attachment and a plurality of spaced apart, transverse nubs positioned on said projection.

4. The lighting system of claim 3 wherein each of said electrical connector halves contains first and second contacts having mating ends and wire fixing ends and first and second pairs of wires connected to said wire fixing ends, said first and second pairs of wires being wound about said transverse nubs to provide strain relief.

* * * * *